US008221101B2

(12) United States Patent
Jeong et al.

(10) Patent No.: US 8,221,101 B2
(45) Date of Patent: Jul. 17, 2012

(54) SCROLL COMPRESSOR WITH DISCHARGE GUIDE

(75) Inventors: Chan-Hwa Jeong, Gyeongsangnam-Do (KR); Hae-Jin Oh, Gyeongsangnam-Do (KR); Hong-Gyun Jin, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 776 days.

(21) Appl. No.: 12/310,786

(22) PCT Filed: Aug. 31, 2007

(86) PCT No.: PCT/KR2007/004214

§ 371 (c)(1),
(2), (4) Date: Mar. 6, 2009

(87) PCT Pub. No.: WO2008/030014

PCT Pub. Date: Mar. 13, 2008

(65) Prior Publication Data

US 2009/0238703 A1 Sep. 24, 2009

(30) Foreign Application Priority Data

Sep. 8, 2006 (KR) ..... 10-2006-0087061

(51) Int. Cl.
*F01C 1/02* (2006.01)
*F01C 1/063* (2006.01)
*F04C 2/00* (2006.01)

(52) U.S. Cl. ..... 418/55.1

(58) Field of Classification Search ..... 418/55.1
See application file for complete search history.

(56) References Cited

U.S. PATENT DOCUMENTS

| | | | | |
|---|---|---|---|---|
| 4,696,629 | A * | 9/1987 | Shiibayashi et al. | 418/55.1 |
| 2006/0057012 | A1 * | 3/2006 | Park et al. | 418/55.1 |
| 2006/0062682 | A1 * | 3/2006 | Cho et al. | 418/55.1 |

FOREIGN PATENT DOCUMENTS

| | | | |
|---|---|---|---|
| CN | 1482365 | | 3/2004 |
| JP | 2000-161268 | A | 6/2000 |
| JP | 2001-329978 | A | 11/2001 |
| JP | 2001329978 | A * | 11/2001 |
| JP | 2003-003974 | A | 1/2003 |
| JP | 2004-100662 | A | 4/2004 |
| JP | 2004100662 | A * | 4/2004 |

* cited by examiner

*Primary Examiner* — Mary A Davis
(74) *Attorney, Agent, or Firm* — McKenna Long & Aldridge LLP

(57) ABSTRACT

A scroll compressor includes a fluid guide having a flow path through which a fluid discharged to an inner space of a casing from a compression part flows, for guiding a flowing direction of the fluid to be changed along the flow path. Oil is effectively separated from a refrigerant discharged from the compression part, thereby being prevented from leaking outside the casing. Oil mixed with the refrigerant is moved to a lower space of the casing by the fluid guide thus to cool a lower winding coil. Accordingly, an efficiency of a driving motor is enhanced, and a performance of the scroll compressor is enhanced.

12 Claims, 5 Drawing Sheets

[Fig. 1]
PRIOR ART
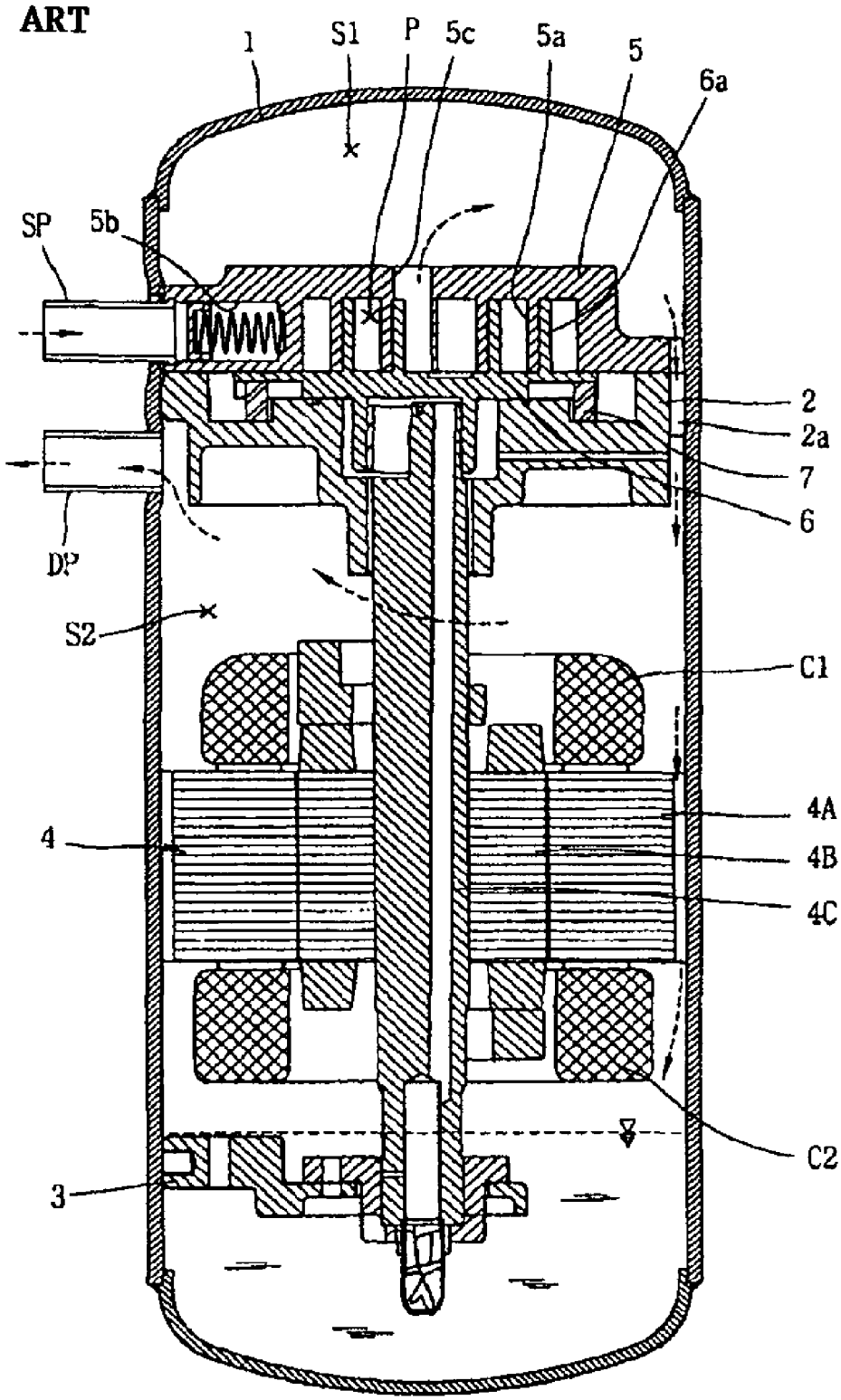

[Fig. 2]
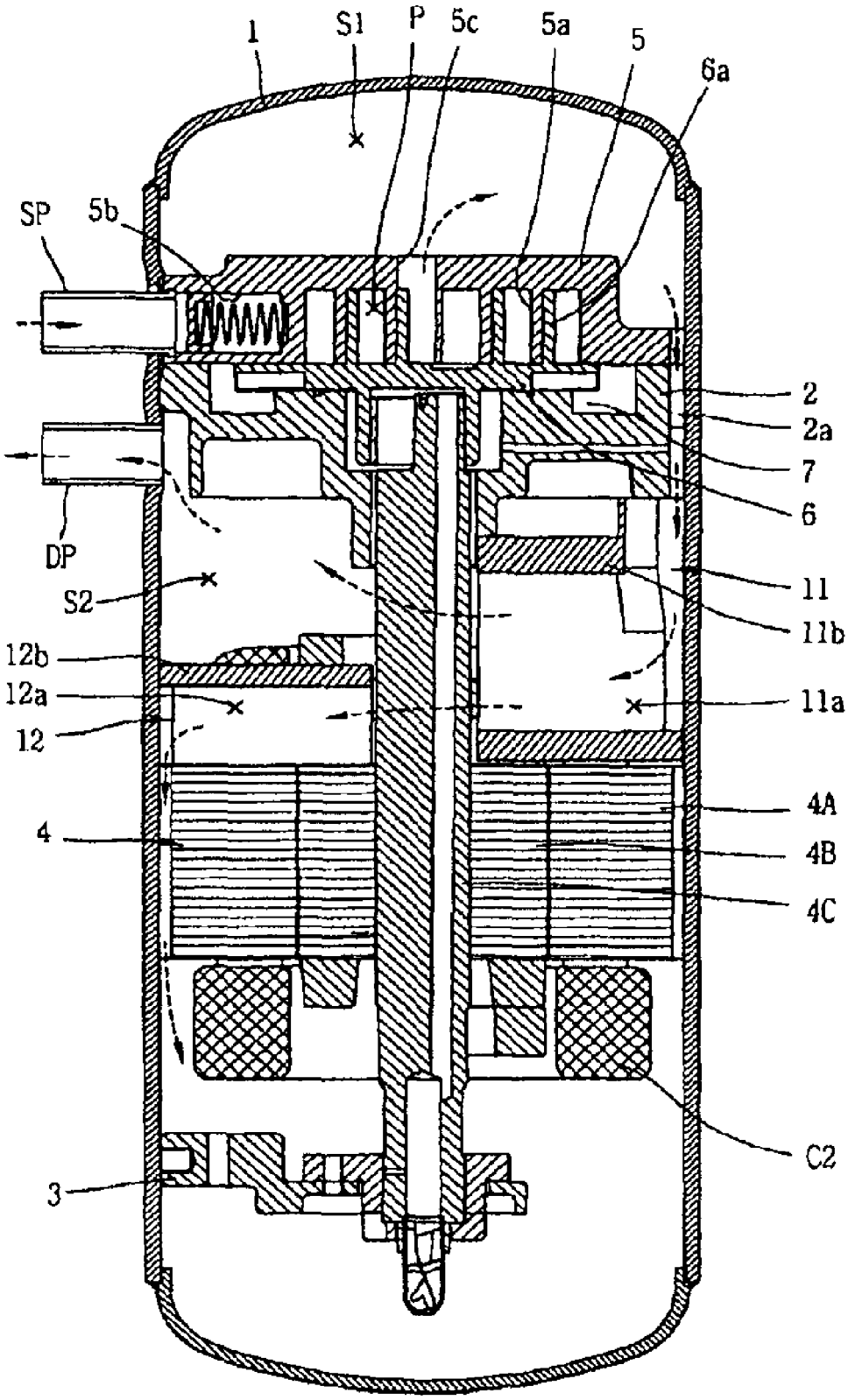

[Fig. 3]
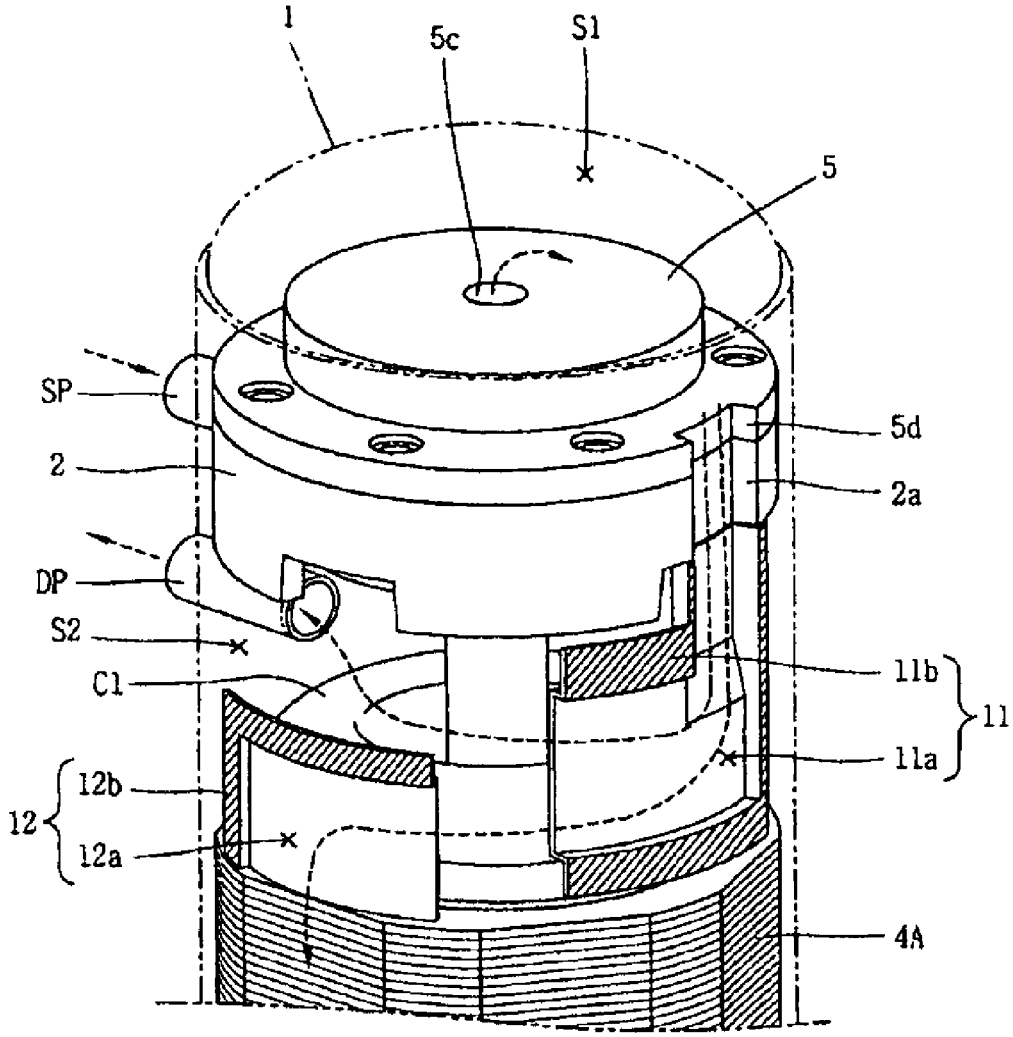
[Fig. 4]
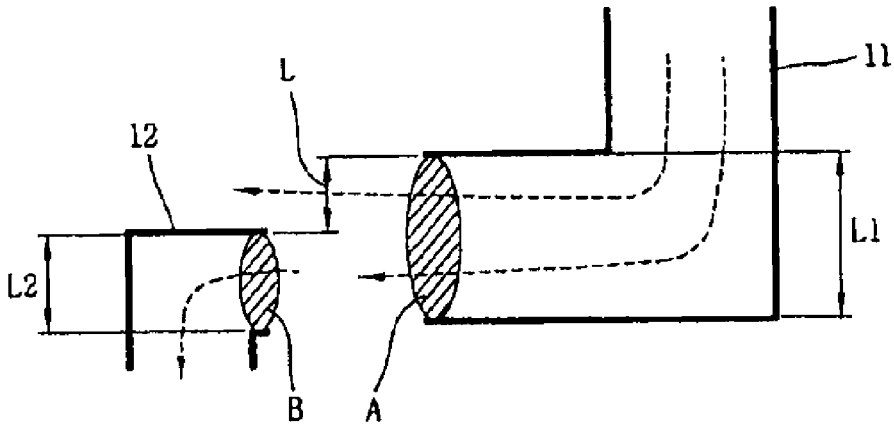

[Fig. 5]
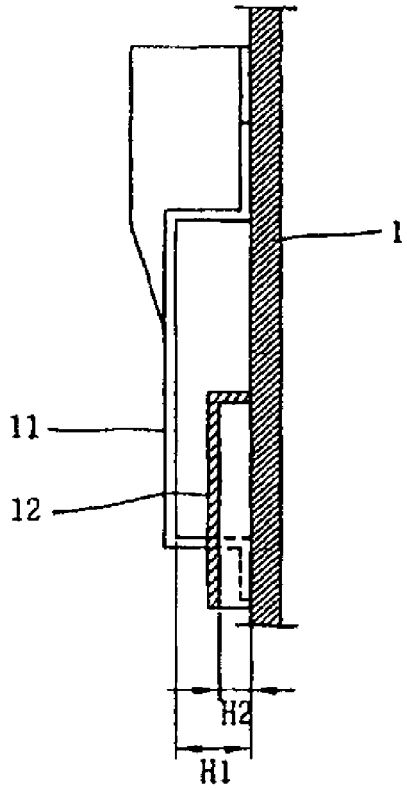
[Fig. 6]
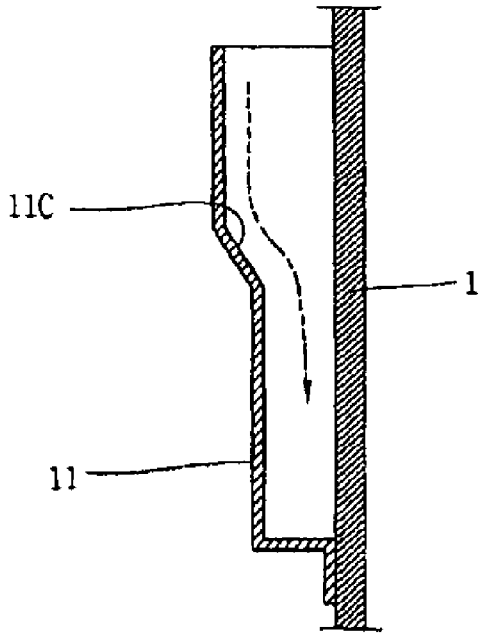

[Fig. 7]
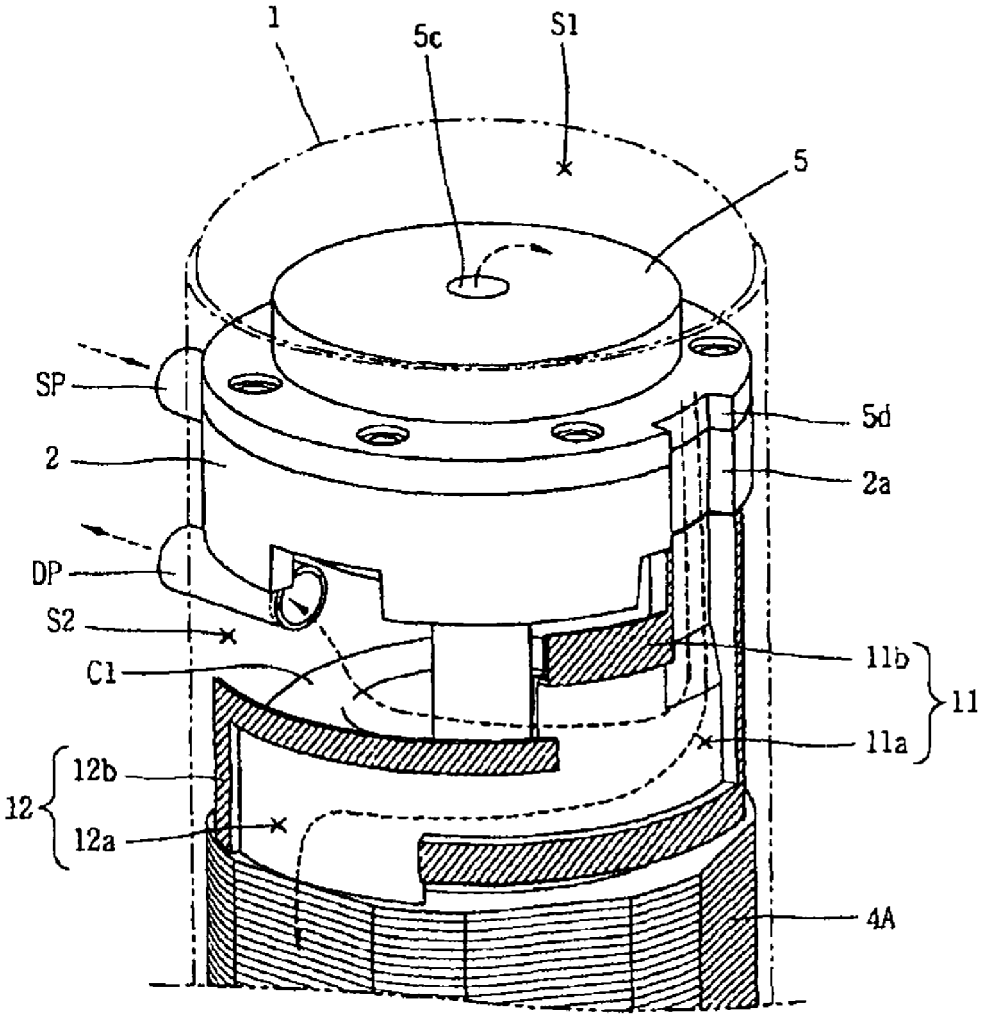

SCROLL COMPRESSOR WITH DISCHARGE GUIDE

This application is a National Stage Entry of International Application No. PCT/KR2007/004214, filed Aug. 31, 2007, and claims the benefit of Korean Application No. 10-2006-0087061, filed on Sep. 8, 2006, which is hereby incorporated by reference for all purposes as if fully set forth herein.

TECHNICAL FIELD

The present invention relates to a scroll compressor.

BACKGROUND ART

Generally, a scroll compressor is widely applied to an air conditioning system with a high efficiency and low noise. In the scroll compressor, two scrolls perform a relative orbiting motion, and a pair of compression chambers are formed between the two scrolls. While consecutively moving towards the centers of the scrolls, the compression chambers have a decreased volume thereby to suck, compress and discharge a refrigerant.

The scroll compressor may be divided into a low pressure type scroll compressor and a high pressure type scroll compressor according to whether suction gas is filled in a casing.

As shown in FIG. 1, the high pressure type scroll compressor comprises: a casing 1 maintaining a high pressure state, and having a gas discharge pipe DP; a main frame 2 and a sub frame 3 fixed to upper and lower sides inside the casing 1, respectively; a driving motor 4 disposed between the main frame 2 and the sub frame 3, for generating a rotation force; a fixed scroll 5 fixed to an upper surface of the main frame 2, and to which a gas suction pipe SP is directly coupled; an orbiting scroll 6 orbitably disposed on an upper surface of the main frame 2 so that a plurality of compression chambers P can be formed by being engaged with the fixed scroll 5; and an Oldham ring 7 disposed between the orbiting scroll 6 and the main frame 2, for orbiting the orbiting scroll 6 with preventing a rotation of the orbiting scroll 6.

At an upper space S1 of the casing 1 based on the main frame 2, the gas suction pipe SP is installed to be directly communicated with an inlet 5*b* of the fixed scroll 5. On the contrary, at a lower space S2 of the casing based on the main frame 2, the gas discharge pipe DP is installed.

An outer circumferential surface of the main frame 2 is adhered to an inner circumferential surface of the casing 1, and is fixed thereto by a welding. The gas discharge pipe DP is disposed on the outer circumferential surface of the main frame 2. A plurality of gas communication recesses 2*a* are formed so that gas discharged through the fixed scroll 5 can be introduced into the gas discharge pipe DP.

An unexplained reference numeral 4A denotes a stator, 4B denotes a rotor, 4C denotes a driving shaft, 5*a* denotes a fixed wrap, 5C denotes an outlet, 6*a* denotes an orbiting wrap, C1 denotes an upper winding coil, and C2 denotes a lower winding coil.

An operation of the conventional high pressure type scroll will be explained.

When power is supplied to the driving motor 4, the driving shaft 4C is rotated together with the rotor 4B, and the orbiting scroll 6 is orbited on an upper surface of the main frame 2 by the Oldham ring as much as an eccentric distance. A plurality of paired compression chambers P moving towards the center of the scroll compressor are consecutively formed between the fixed wrap 5*a* of the fixed scroll 5 and the orbiting wrap 6*a* of the orbiting scroll 6. While the orbiting scroll 6 continues to perform an orbiting motion, the plurality of paired compression chambers P have decreased volumes towards the center of the scroll. Accordingly, a refrigerant is sucked, compressed, and discharged.

A refrigerant is sucked into the inlet 5*b* of the fixed scroll 5 through the gas suction pipe SP, is compressed at a compression chamber P, and then is discharged to the upper space of the casing 1 through the outlet 5*c* of the fixed scroll 5. A refrigerant discharged to the upper space S1 of the casing 1 is moved to the lower space S2 of the casing 1 via the gas communication recess 2*a* of the main frame 2, and then is discharged to a refrigerating cycle system through the gas discharge pipe DP.

On the contrary, oil is sucked through an oil flow path of the driving shaft 5 by a centrifugal force when the driving shaft 5 is fast rotated, thereby being supplied to each surface to be lubricated. Then, the oil having performed a lubricating operation is recollected to a bottom of the casing 1 together with oil separated from a refrigerant discharged from the compression chamber P.

DISCLOSURE OF INVENTION

Technical Problem

However, the conventional high pressure type scroll compressor has the following problems.

First, since the refrigerant moved to the lower space S2 of the casing 1 is not moved up to the lower winding coil C2 of the driving motor 4, the winding coil is not uniformly cooled. Accordingly, a partial overheating of the driving motor 4 occurs, and thus a reliability of the scroll compressor is lowered.

Second, when a refrigerant discharged to the upper space S1 of the casing 1 from the compression chamber P with a certain amount of oil is moved to the lower space S2 of the casing 1, the refrigerant is fast discharged to the gas discharge pipe DP. Here, a large amount of oil is discharged to the system together with the refrigerant. Accordingly, oil leakage occurs in the scroll compressor thus to cause an abrasion at each frictional part, thereby lowering a reliability of the scroll compressor. Also, since a large amount of oil is introduced into the system, an entire function of the system is lowered.

Technical Solution

Therefore, it is an object of the present invention to provide a scroll compressor capable of preventing a lowering of a reliability thereof by uniformly cooling a driving motor.

It is another object of the present invention to provide a scroll compressor capable of easily separating oil from a refrigerant discharged to an inner space of a casing from a compression chamber.

To achieve these objects, there is provided a scroll compressor, comprising: a casing: a frame fixedly installed at an inner space of the casing; a driving motor disposed at the casing, for generating a driving force; a compression part for compressing a refrigerant by receiving a driving force of the driving motor as two scrolls perform a relative motion; and a fluid guide having a flow path through which a fluid discharged to the inner space of the casing from the compression part flows, for guiding a flowing direction of the fluid to be changed along the flow path.

According to another aspect of the present invention, there is provided a scroll compressor, comprising: a casing to which a gas suction pipe and a gas discharge pipe are connected; a frame fixedly installed at an inner space of the casing so as to be disposed between the gas suction pipe and the gas discharge pipe; a driving motor disposed at the casing, for generating a driving force; a fixed scroll having an outlet so as to be communicated with the inner space of the casing, and fixed to the frame; an orbiting scroll engaged with the fixed scroll, performing an orbiting motion by being eccentrically coupled to a driving shaft, and forming a pair of compression chambers that consecutively move; and a plurality of fluid guides disposed at the inner space of the casing, and having flow paths in different directions so that a fluid discharged to the inner space of the casing can flow in different directions.

Advantageous Effects

A scroll compressor includes a fluid guide having a flow path through which a fluid discharged to an inner space of a casing from a compression part flows, for guiding a flowing direction of the fluid to be changed along the flow path. Oil is effectively separated from a refrigerant discharged from the compression part, thereby being prevented from leaking outside the casing. Oil mixed with the refrigerant is moved to a lower space of the casing by the fluid guide thus to cool a lower winding coil. Accordingly, an efficiency of a driving motor is enhanced, and a performance of the scroll compressor is enhanced.

BRIEF DESCRIPTION OF THE DRAWINGS

FIG. 1 is a sectional view showing a high pressure type scroll compressor in accordance with the conventional art;

FIG. 2 is a sectional view showing a high pressure type scroll compressor according to the present invention;

FIG. 3 is a perspective view showing inside of a casing of the high pressure type scroll compressor of FIG. 2 according to the present invention;

FIG. 4 is a front schematic view showing a state that a fluid guide of FIG. 3 is arranged;

FIG. 5 is a side schematic view showing a state that the fluid guide of FIG. 3 is arranged;

FIG. 6 is a sectional view taken along line I-I of FIG. 3; and

FIG. 7 is a perspective view showing a fluid guide of the high pressure type scroll compressor according to another embodiment of the present invention.

BEST MODE FOR CARRYING OUT THE INVENTION

Hereinafter, a scroll compressor according to the present invention will be explained in more detail with reference to the attached drawings.

Referring to FIG. 2, a high pressure type scroll compressor comprises: a casing 1 having a certain amount of oil therein, maintaining a high pressure state, and having a hermetic inner space so that a gas discharge pipe DP can be communicated therewith; a main frame 2 and a sub frame 3 fixed to upper and lower sides inside the casing 1, respectively; a driving motor 4 disposed between the main frame 2 and the sub frame 3, for generating a rotation force; a fixed scroll 5 fixed to an upper surface of the main frame 2, and to which a gas suction pipe SP is directly coupled; an orbiting scroll 6 that performs an orbiting motion on an upper surface of the main frame 2 by being engaged with the fixed scroll 5, and having one pair of compression chambers P; an Oldham ring 7 disposed between the orbiting scroll 6 and the main frame 2, for orbiting the orbiting scroll 6 with preventing a rotation of the orbiting scroll 6; and a plurality of fluid guides 10 disposed at the casing 1, for guiding a refrigerant flowing to a lower space S2 from an upper space S1 of the casing 1, and separating oil from the refrigerant.

At the upper space S1 of the casing 1 based on the main frame 2, the gas suction pipe SP is installed to be directly communicated with an inlet 5*b* of the fixed scroll 5. On the contrary, at a lower space S2 of the casing 1 based on the main frame 2, the gas discharge pipe DP is installed.

An outer circumferential surface of the main frame 2 is adhered to an inner circumferential surface of the casing 1, and is fixed thereto by a welding. The gas discharge pipe DP is disposed on the outer circumferential surface of the main frame 2. A plurality of gas communication recesses 2*a* are formed so that gas discharged to the upper space S1 of the casing 1 through the fixed scroll 5 can be moved to the lower space S2 thus be introduced into the gas discharge pipe DP.

The driving motor 4 includes a stator 4A insertion-fixed to an inner circumferential surface of the casing 1, a rotor 4B rotatably coupled to inside of the stator 4A with an air gap, and a driving shaft 4C forcibly inserted into the center of the rotor 4B for transmitting a rotation force to the orbiting scroll 6.

The fixed scroll 5 includes a fixed wrap 5*a* that forms one pair of compression chambers P at a bottom surface of a plate portion, and having an involute shape; an inlet 5*b* disposed at a side surface of the plate portion, and communicated with the gas suction pipe SP; an outlet 5*c* disposed at a center of an upper surface of the plate portion, communicated with a center of the fixed wrap 5*a*, and through which a compressed refrigerant is discharged to the upper space S1 of the casing 1; and a gas passing groove 5*d* disposed at an edge of the plate portion, and connected to the gas communication recess 2*a* of the main frame 2.

The orbiting scroll 6 has an orbiting wrap 6*a* of an involute shape on an upper surface of the plate portion so that one pair of compression chambers P can be formed together with the fixed wrap 5*a* of the fixed scroll 5. A boss portion (not shown) connected to the driving shaft 4C and receiving a driving force of the driving motor 4 is disposed at a center of the bottom surface of the plate portion.

Referring to FIG. 3, the fluid guide includes a first fluid guide 11 for converting a flowing direction of a fluid from a shaft direction of the driving motor to a rotation direction; and a second fluid guide 12 disposed at the casing so as to be communicated with an outlet of the first fluid guide 11 with a certain interval, for converting the flowing direction of the fluid having passed through the first fluid guide 11 to the shaft direction of the driving motor 4.

The first fluid guide 11 includes a first flow path 11*a* concaved at a center of a planar surface with a shape of -and a first fixed plane 11*b* disposed at edges of the first flow path 11*a* rather than both ends with the same curvature as an inner circumferential surface of the casing 1 so as to be adhered to the inner circumferential surface of the casing 1.

The second fluid guide 12 includes a second flow path 12*a* concaved at a connection surface to the first fluid guide 11 with a certain depth; and a second fixed plane 12*b* disposed at some edges of the second flow path 12*a* with a shape of ¬and having the same curvature as an inner circumferential surface of the casing 1 so as to be adhered to the inner circumferential surface of the casing 1.

Preferably, a refrigerant separated from oil included in a fluid having passed through the first fluid guide 11 serves to cool the upper winding coil C1 of the driving motor 4. However, preferably, the rest refrigerant mixed with the oil is moved to a bottom surface of the casing 1, thereby cooling the lower winding coil C2 of the driving motor 4.

Preferably, 20~60% of a fluid discharged from an outlet of the first fluid guide 11 is introduced into an inlet of the second fluid guide 12.

As shown in FIG. 4, a sectional area A of the outlet of the first fluid guide 11 is larger than a sectional area B of the inlet of the second fluid guide 12 Also, a length L1 of the outlet of the first fluid guide 11 in a shaft direction is longer than a length L2 of the inlet of the second fluid guide 12 in a shaft direction.

As shown in FIG. 5, a height H1 of the outlet of the first fluid guide 11 in a radius direction is higher than a height H2 of the inlet of the second fluid guide 12 in a radius direction. As shown in FIGS. 4 and 5, an upper dead point of the outlet of the first fluid guide 11 is disposed to be higher than an upper dead point of the inlet of the second fluid guide 12.

Preferably, the first fluid guide 11 is installed so that an inlet thereof is spaced from the main frame 2 by a distance of 1/10 of an inner diameter of the casing 1 or less.

In order to enhance an efficiency to cool the upper winding coil C1, an upper end of the first fluid guide 11 is preferably disposed to be higher than an upper end of the driving motor 4, but an upper end of the second fluid guide 12 is preferably disposed to be lower than the upper end of the driving motor 4.

Although not shown, the fluid guide 11 has a rounded portion at a point where a flowing direction of a fluid is changed, thereby smoothly flowing the fluid.

As shown in FIG. 6, either the first flow path 11*a* of the first fluid guide 11 or the second flow path 12*a* of the second fluid guide 12 is provided with a stepped portion 11C (not shown) so that a middle part of a flow passage of a fluid can be narrowed, thereby accelerating a flowing speed of the fluid and smoothly separating a refrigerant from oil.

The first fluid guide 11 and the second fluid guide 12 are preferably fixed to an inner circumferential surface of the casing 1 by a welding, but may be fixed thereto by an additional fixing member.

Referring to FIGS. 3 to 6, the first fluid guide 11 is spaced from the second fluid guide 12 with a certain distance. However, as shown in FIG. 7, the inlet of the second fluid guide 12 may be connected to the outlet of the first fluid guide 11. A flow path through which a refrigerant having passed through the first fluid guide 11 is partially discharged to the gas discharge pipe DP may be formed between the first fluid guide 11 and the second fluid guide 12. Differences of sectional areas and heights between the outlet of the first fluid guide 11 and the inlet of the second fluid guide 12 are similar to the aforementioned ones, and thus their detailed explanation will be omitted.

The same reference numerals were given to the same parts as those of the conventional art.

An operation of the high pressure type scroll compressor according to the present invention will be explained.

As the driving shaft 4C is rotated together with the rotor 4B by power supplied to the driving motor 4, the orbiting scroll 6 is orbited by an eccentric distance. A pair of compression chambers P that have a decreased volume while consecutively moving between the orbiting scroll 6 and the fixed scroll 5, thereby sucking, compressing and discharging a refrigerant.

Here, the refrigerant is directly sucked into the inlet 5*b* of the fixed scroll 5 through the gas suction pipe SP, is compressed in the compression chamber P, and is discharged to the upper space S1 of the casing 1 through the outlet 5*c*. Then, the discharge gas is moved to the lower space S2 of the casing 1 via the gas connection grove 2*a* of the main frame 2.

The discharge gas passing through the gas communication recess 2*a* of the main frame 2 passes through the first flow path 11*a* of the first fluid guide 11, thereby converting its flowing direction from a shaft direction of the rotor 4B to a rotation direction. The discharge gas passing through the gas communication recess 2*a* of the main frame 2 passes through the first flow path 11*a* of the first fluid guide 11, thereby converting its flowing direction from a shaft direction of the rotor 4B to a rotation direction. Then, the discharge gas passes through the second flow path 12*a* of the second fluid guide 12, thereby re-converting its flowing direction from the rotation direction of the rotor 4B to the shaft direction. The discharge gas moves up to a lower portion of the driving motor 4, and then is discharged to the refrigerating cycle system through the gas discharge pipe DP after passing through the lower space S2 of the casing 1.

A refrigerant separated from oil included in a fluid having passed through the first fluid guide 11 is not introduced into the second fluid guide 12, but is introduced to an upper side of the lower space S2 of the casing 1, thereby cooling the upper winding coil C1 of the driving motor 4. However, the rest refrigerant having not been separated from the oil is moved to a lower portion of the casing 1. Here, the oil separated from the refrigerant is collected to the casing 1, whereas the refrigerant separated from the oil is guided to the gas discharge pipe DP after circulating the lower space S2 of the casing 1. Then, the refrigerant is discharged out through the gas discharge pipe DP.

The refrigerant discharged to the upper side of the lower space S2 of the casing 1 from the first fluid guide 11 without being introduced into the second fluid guide 12 cools the upper winding coil C1 of the driving motor 4, whereas the refrigerant discharged from the second fluid guide 12 cools the lower winding coil C2 of the driving motor 4. Accordingly, the efficiency of the driving motor 4 is enhanced.

Furthermore, the oil discharged from the compression chamber P together with the refrigerant is separated from the refrigerant while passing through the first and second fluid guides 11 and 12. The oil is also separated from the refrigerant while being guided to the lower portion of the casing 1. Accordingly, the oil is prevented from leaking to the refrigerating cycle system.

In the scroll compressor according to the present invention, oil is effectively separated from a refrigerant discharged from the compression chamber by the fluid guide, thereby being prevented from leaking to outside of the casing.

Furthermore, oil mixed with a refrigerant is moved to the lower space of the casing along the fluid guide thus to cool the lower winding coil. Accordingly, the efficiency of the driving motor is enhanced thus to enable the scroll compressor to have an enhanced function.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A scroll compressor, comprising:

a sealed casing:

a frame fixedly installed at an inner space of the sealed casing;

a driving motor disposed at the sealed casing, for generating a driving force;

a compression part for compressing a refrigerant by receiving a driving force of the driving motor as two scrolls perform a relative motion; and a fluid guide having a flow path through which a fluid discharged to the inner space of the sealed casing from the compression part flows, for guiding a flowing direction of the fluid to be changed along the flow path, wherein the fluid guide comprises:

a first fluid guide having an inlet open in an axial direction thereof towards a discharge side of the compression part and an outlet open in a circumferential direction thereof such that a flowing direction of fluid is converted from an axial direction into a circumferential direction of the driving motor; and a second fluid guide is consecutively disposed and spaced from each other by a predetermined distance, having an inlet open in the circumferential direction to correspond to the outlet of the first fluid guide and an outlet open towards a gap between the driving motor and the sealed casing such that a flowing direction of fluid having passed through the first fluid guide is converted from the circumferential direction into a downward axial direction of the driving motor, wherein the first and second fluid guides are disposed so that an outlet of the first fluid guide have a sectional area larger than that of an inlet of the second fluid guide.

2. The scroll compressor of claim 1, wherein the first and second fluid guides are disposed so that an outlet of the first fluid guide have a length in a shaft direction longer than a length of an inlet of the second fluid guide in a shaft direction.

3. The scroll compressor of claim 1, wherein the first and second fluid guides are disposed so that a height of an outlet of the first fluid guide in a radius direction higher than a height of an inlet of the second fluid guide in a radius direction.

4. The scroll compressor of claim 1, wherein the first and second fluid guides are disposed so that an upper dead point of an outlet of the first fluid guide is higher than an upper dead point of an inlet of the second fluid guide.

5. The scroll compressor of claim 1, wherein the first and second fluid guides are disposed so that 30~50% of a fluid discharged through an outlet of the first fluid guide is introduced into an inlet of the second fluid guide.

6. The scroll compressor of claim 1, wherein the first and second fluid guides are disposed so that an inlet of the first fluid guide spaced from the frame by a distance of 1/10 of an inner diameter of the casing or less.

7. The scroll compressor of claim 1, wherein the first and second fluid guides are disposed so that an upper end of the first fluid guide is higher than an upper end of the driving motor, but an upper end of the second fluid guide is lower than the upper end of the driving motor.

8. The scroll compressor of claim 1, wherein the fluid guide is fixed to an inner circumferential surface of the casing by a welding.

9. The scroll compressor of claim 1, wherein the fluid guide has a rounded portion at a point where a flowing direction of a fluid is changed.

10. The scroll compressor of claim 1, wherein the fluid guide is formed so that a middle part thereof is stepped.

11. The scroll compressor of claim 1, wherein the first fluid guide has a first flow path concaved at a center of a planar surface with a shape of ⌙, and a first fixed plane is disposed at edges of the first flow path rather than both ends so as to be adhered to an inner circumferential surface of the casing.

12. The scroll compressor of claim 1, wherein the second fluid guide has a second flow path concaved at a connection surface to the first fluid guide with a certain depth, and a second fixed plane is disposed at some edges of the second flow path with a shape of ¬so as to be adhered to an inner circumferential surface of the casing.

* * * * *